United States Patent [19]

Paetow

[11] Patent Number: 4,951,843

[45] Date of Patent: Aug. 28, 1990

[54] DISPOSABLE MIXING CHAMBER LINER AND PADDLE FOR A DYNAMIC MIXING AND DISPENSING GUN

[75] Inventor: William C. Paetow, Drayton Plains, Mich.

[73] Assignee: Sealant Equipment & Engineering, Inc., Oak Park, Mich.

[21] Appl. No.: 394,677

[22] Filed: Aug. 16, 1989

[51] Int. Cl.[5] ..... B05B 1/00

[52] U.S. Cl. ..... 222/145; 239/142; 239/591; 239/600; 366/250; 366/279; 366/309

[58] Field of Search ..... 222/135, 136, 137, 145; 239/591, 600, 527, 142, 399, 427, 432; 366/309, 279, 325, 328, 177, 98, 99, 247-251

[56] References Cited

U.S. PATENT DOCUMENTS

| | | | |
|---|---|---|---|
| 1,508,841 | 9/1924 | Farrington | 366/248 |
| 2,543,517 | 2/1951 | Anderson . | |
| 2,641,455 | 6/1953 | Poirot | 366/251 X |
| 2,671,692 | 3/1954 | Matirko | 239/591 X |
| 2,868,518 | 1/1959 | Corby, Jr. et al. . | |
| 2,992,777 | 7/1961 | Kinney et al. | 239/591 X |
| 3,035,775 | 5/1962 | Edwards et al. | 239/142 |
| 3,132,808 | 5/1964 | Ott | 239/415 |
| 3,193,202 | 7/1965 | Liggenstorfer et al. | 239/142 |
| 3,302,832 | 2/1967 | Hardman et al. | 222/94 |
| 3,304,010 | 2/1967 | Cantrell et al. | 239/142 |
| 3,306,540 | 2/1967 | Reichert | 239/142 |
| 3,358,971 | 12/1967 | Steinback, Jr. . | |
| 3,606,094 | 9/1971 | Mills et al. | 222/145 |
| 3,622,126 | 11/1971 | Eberle | 239/399 X |
| 3,633,795 | 1/1972 | Brooks | 222/134 |
| 3,767,085 | 10/1973 | Cannon et al. | 222/145 X |
| 3,784,110 | 1/1974 | Brooks | 239/304 |
| 3,931,933 | 1/1976 | Cairns et al. | 239/591 |
| 4,067,479 | 1/1978 | Moline | 222/137 X |
| 4,146,333 | 3/1979 | Zani | 366/99 |
| 4,168,033 | 9/1979 | von Bernuth et al. | 239/523 |
| 4,603,813 | 8/1986 | Luegering | 239/399 |
| 4,762,253 | 8/1988 | Palmert | 222/145 |

FOREIGN PATENT DOCUMENTS

| | | | |
|---|---|---|---|
| 1387695 | 3/1975 | United Kingdom | 366/247 |

*Primary Examiner*—Kevin P. Shaver
*Attorney, Agent, or Firm*—Basile and Hanlon

[57] ABSTRACT

A gun for dynamic mixing and discharging of a chemical mixture, such as a sealant, includes a mixing chamber with a motor-driven spindle mounted for rotation within the mixing chamber and a discharge outlet from the mixing chamber. A disposable mixing chamber liner is insertable within the mixing chamber and sealingly engageable with the gun. A disposable mixing paddle is releasably engageable with the spindle for rotation within the mixing chamber.

13 Claims, 1 Drawing Sheet

DISPOSABLE MIXING CHAMBER LINER AND PADDLE FOR A DYNAMIC MIXING AND DISPENSING GUN

BACKGROUND OF THE INVENTION

I. Field of the Invention

The invention relates to an apparatus for dynamically mixing and dispensing multi-component fluids and, more particularly, it concerns a dynamic mixing and dispensing gun adapted to be used with systems in which two or more fluid components, separately stored in dispensing vessels, are mixed and dispensed as a settable sealant, wherein the mixing occurs in a mixing chamber liner with a mixing paddle which constitutes a disposable chamber and paddle combination that can eliminate hours of cleaning associated with non-disposable components.

II. Description of the Related Art

U.S. Pat. Nos. 4,762,253 and 4,603,813 disclose dispensing guns in which separate fluid components are fed individually to the gun, passed separately through controlled valve ports and brought into contact with each other only upon reaching a mixing chamber of a nozzle from which the mixed components are discharged. The nozzles for the gun are designed to be replaceable and disposable in order to avoid the necessity of cleaning any part of the gun which comes into contact with mixed, as distinguished from separate, fluid components. The nozzles are retained on the gun body with relative rigidity, without leakage of fluid components between the gun body and the nozzle, and yet in a manner to facilitate nozzle removal and replacement. Each of these patents includes a stationary, helically configured mixing guide or baffle positioned within the mixing chamber for imparting a controlled, helical, swirling or mixing action to the liquid components entering the chamber from the inlet ports, and to increase the amount of time within the mixing chamber. This type of stationary, baffle configuration is satisfactory for chemicals which are easily mixed, and for chemicals which expand after mixing due to the presence or formation of a blowing agent, such as that present in foam products. However, this stationary, baffle configuration is unsatisfactory where more vigorous dynamic mixing is required.

U.S. Pat. No. 3,622,126 discloses a spray gun for mixing and applying a two-part mixture, such as a plastic and a catalyst. The spray gun has a mixing chamber that receives at one end thereof controlled or metered amounts of the two ingredients of the mixture from their respective sources of supply and discharges the mixture from an outlet at the other end. A mixing rotor is provided with mixing blades extending radially from a central body. The rotor is mounted in the chamber and is rotated continuously while the gun is in use. The upstream sides of the rotor blades are inclined relative to their respective planes of rotation to exert an axial flow, impeller-type action on the contents of the chamber, thereby creating a high-degree of turbulence within the chamber that tends to propel the contents back away from the chamber outlet. After each period of use, it is essential to thoroughly clean the gun of the catalyzed plastic. This is accomplished by shutting off the flow of plastic and catalyst to the mixing chamber and supplying a suitable pressurized cleaning solvent, such as acetone, to the chamber. With the acetone in the chamber, the rotor is rotatively driven to create an extreme turbulence and flushing of the mixed plastic and catalyst from the mixing chamber. The rotor tends to drive the acetone fluid axially inward, flushing the mixed plastic and catalyst from the chamber at the outlets of the passages, assuring that all of the mixed contents are flushed out of the chamber. This type of dynamic mixing and dispensing gun suffers from the disadvantage of having to be flushed with a suitable solvent for cleaning the mixing chamber after use. The use of solvents for cleaning is time consuming, expensive and creates solvent waste disposal problems.

SUMMARY OF THE INVENTION

The present invention addresses the problems associated with the previously known mixing and dispensing guns by providing a disposable mixing chamber liner and disposable mixing rotor or paddle. The invention is used with a conventional dynamic mixing and dispensing gun that has a body with a hand grip and an actuating trigger. An air hose is connected to the gun and communicates with a supply of compressed air. Separate chemical supply reservoirs communicate through passages in the gun body with an inlet end of a mixing chamber. Means are provided for securing the disposable mixing chamber liner in sealed relation on the discharge end of the gun body. A disposable mixing rotor or paddle is mounted within the mixing chamber, releasably coupled to a shaft which is journaled in bearings provided for it in the gun body. The shaft extends through the gun body and is connected to motor means for rotatably driving the shaft and connected paddle in the mixing chamber.

The mixing paddle preferably takes a generally rectangular, planer form. The paddle preferably has slots formed therein to provide greater turbulence in the mixing chamber. The paddle is loosely engaged within a slot formed in the end of the shaft for rotation within the mixing chamber. The paddle is held in engagement within the slot by the outer end of the mixing chamber liner. While rotating, the loose fit of the paddle within the slot of the shaft allows the paddle to shift radially such that one longitudinal edge of the paddle scrapes against the inner wall of the mixing chamber liner to prevent buildup and promote better mixing.

The disposable mixer chamber/paddle combination of the present invention eliminates the use of solvents. The present invention also combines the resin and catalyst within the mixer chamber/paddle combination into a single disposable entity. The tongue and groove design of the paddle and paddle adaptor coupling makes it possible for an operator to disengage and dispose of the resin and catalyst with the mixer chamber/paddle combination without coming into contact with the chemical.

Further advantages of the present invention will be apparent to those skilled in the art upon examination of the following drawing and description of the preferred embodiment.

BRIEF DESCRIPTION OF THE DRAWING

The description makes reference to the accompanying drawing wherein like reference numerals refer to like parts throughout the several views, and wherein.

DESCRIPTION OF THE PREFERRED EMBODIMENT

Figure 3:
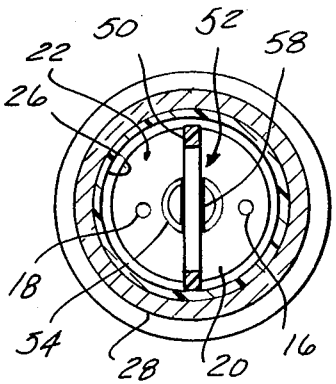
FIG. 3 is a cross-sectional view taken as shown in FIG. 2.
Figure 2:
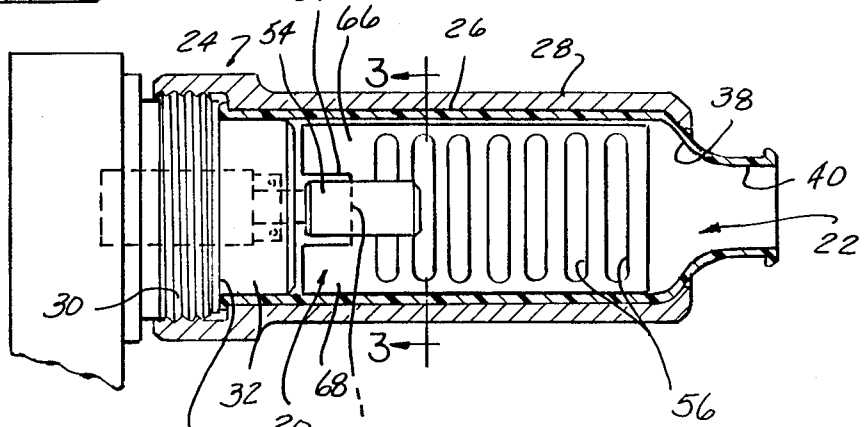
FIG. 2 is a cross-sectional view of the discharge end the gun.
Figure 1:
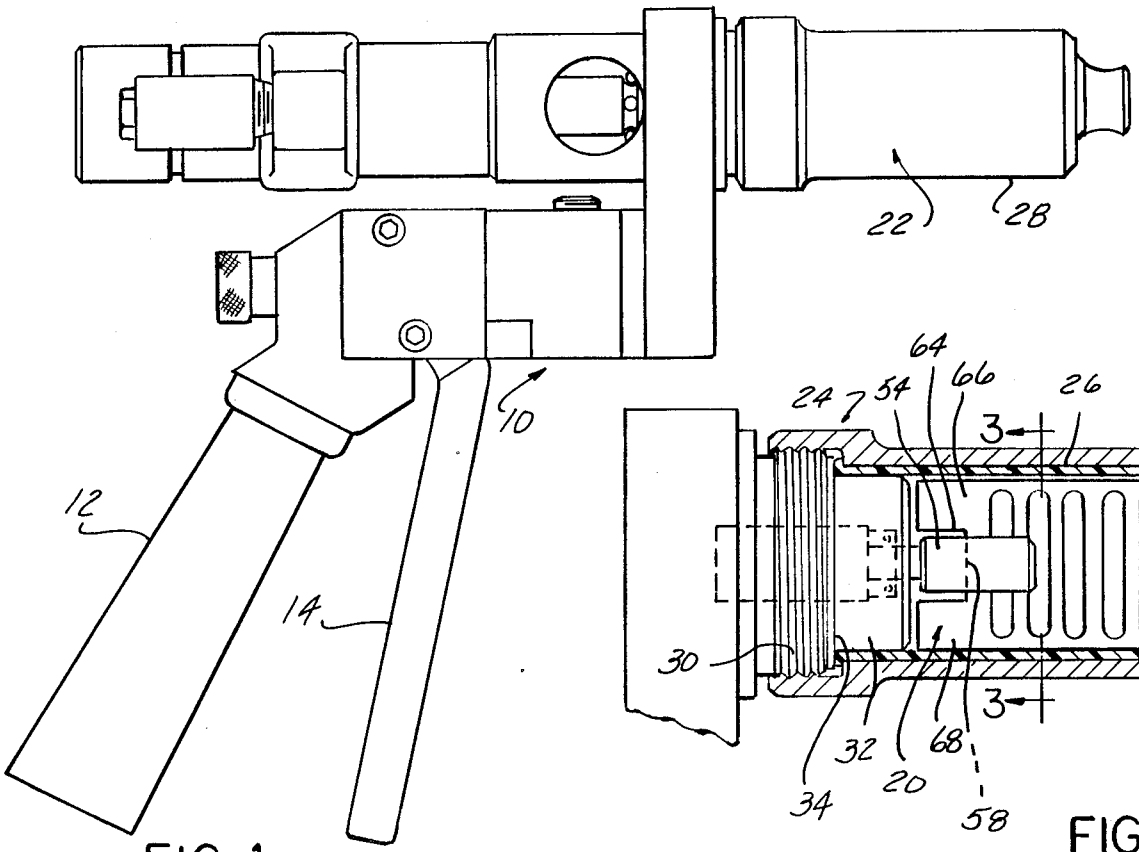
FIG. 1 is a side view of a dynamic mixing and dispensing gun in accordance with the present invention.

A conventional dynamic mixing and dispensing gun includes a body 10 with a hand grip 12 and an actuating trigger 14. A pressurized air hose is connected to the body 10 and communicates with a suitable supply of compressed air (not shown). Chemical supply means communicate through passages 16 and 18 in the gun body 10 with the inlet end 20 of a mixing chamber 22. Means 24 for securing the mixing chamber liner 26 in sealed relation on the discharge end of the gun body 10 is provided. The securing means 24 can include a tubular housing 28 threadingly engaged on the discharge end of the gun body 10 to substantially enclose the inlet end 20 of the mixing chamber 22. The tubular housing 28 threadingly engages an enlarged threaded shoulder 30 at the discharge end of the gun body 10. The tubular housing 28 draws the mixing chamber liner 26 over a smaller, second annular shoulder, adjacent the inlet end 20 of the mixing chamber 22, and sealingly engages the mixing chamber liner 26 in abutment against the transitional surface 34 between the enlarged shoulder 30 and the smaller shoulder 32. The tubular housing 28 has an opening generally opposite to the inlet end 20 of the mixing chamber 22. The mixing chamber liner 26 includes an elongated cylindrical portion 36, a tapering transitional portion 38 and a nozzle or outlet 40. The mixing chamber liner 26 also includes an outwardly flared annular ridge or flange at one end of the cylindrical portion 36 opposite from the outlet 40. The annular ridge engages the gun body adjacent the transitional surface 34 for sealing engagement between the transitional surface 34 and the tubular housing 28. The tubular housing 28 also includes a tapered shoulder adjacent its opposite end to engage and hold the tapering transitional portion 38 of the mixing chamber liner 26.

A disposable mixing rotor or paddle 50 is mountable within the mixing chamber liner 26. Means 52 releasably couples the paddle 50 to a shaft 54 which is journaled in the gun body 10 and is operably connected to a drive shaft of motor means for rotating the shaft 54. The motor means can comprise an air motor, an electric motor or other suitable devices known in the art mounted on the gun body 10. As is conventional in the art, the air motor can be driven by compressed air supplied through air passages and through conventional trigger valve controlled passages in the gun body 10. Preferably, the paddle 50 takes a generally rectangular, planer form. Radially extending slots 56 can be formed in the paddle 50 to provide greater turbulence in the mixing chamber 22. Preferably, a plurality of radially extending slots are disposed along the longitudinal length of the generally rectangular planer paddle 50. The coupling means 52 in this preferred embodiment can include a paddle-receiving groove or slot 58 formed in an end of the shaft 54 disposed within the mixing chamber 22. The paddle 50 is releasably engaged within the paddle-receiving slot 58 to provide a loose fit such that the paddle 50 is driven in a radially outward direction during rotation, allowing one longitudinal edge of the paddle 50 to engage an inner surface of the mixing chamber liner 26, thereby scraping the inner surface of the liner 26 to prevent buildup. The paddle 50 is retained within the paddle-receiving slot 58 in the longitudinal direction by the relatively close proximity of the tapering transitional portion 38 of the liner 26. In its preferred form, the paddle 50 includes a notch 64 formed at one end thereof. Adjacent the notch 64 is a generally planar tongue portion of the paddle 50 for engagement with the paddle-receiving slot 58 in the shaft 54. The paddle 50 includes portions 66 and 68 on either side of the notch 64 which straddle the shaft 54 coming in close proximity to the inlet end 20 of the mixing chamber 22.

While the invention has been described in detail, it will be apparent to those skilled in the art that the disclosed invention may be modified. Therefore, the foregoing description is to be considered exemplary, rather than limiting, and the true scope of the invention is that defined in the following claims.

The invention claimed is:

1. In a gun for mixing and discharging a chemical mixture, said gun having a mixing chamber with a motor-driven shaft mounted for rotation within said mixing chamber and a discharge outlet from said mixing chamber, the improvement comprising:

a disposable mixing chamber liner releasably disposed within said mixing chamber and sealingly engageable with said gun; and a disposable mixing paddle releasably engageable with said shaft for rotation within said mixing chamber, said paddle loosely engageable with said shaft to allow radial movement of said paddle during rotation permitting a longitudinal edge of said paddle to engage and scrape along an inner surface of said mixing chamber liner to prevent chemical buildup during use.

2. The improvement of claim 1 further comprising means for securing said disposable mixing chamber liner in sealed relation with said gun.

3. The improvement of claim 1 further comprising means for releasably coupling said disposable mixing paddle with said shaft for rotation within said mixing chamber liner.

4. The improvement of claim 1, wherein said mixing chamber liner includes an elongated cylindrical portion having an outwardly flared annular ridge at one end and a tapering transitional portion at another end, said tapering transitional portion forming an outlet for said mixing chamber liner.

5. The improvement of claim 4 further comprising:

said gun having an inlet end with passages opening into said mixing chamber, a first smooth annular shoulder adjacent said inlet end, a second enlarged shoulder with a threaded external surface adjacent said first shoulder and a transitional surface between said first and second shoulders;

a tubular housing having a threaded aperture engageable with said threaded surface of said enlarged shoulder at one end, and a tapered shoulder adjacent an opposite end, such that said outwardly flared flange of said mixing chamber liner is sealingly engaged between said transitional surface of said gun and said tubular housing while said tapered shoulder of said tubular housing engages said tapering transitional portion of said mixing chamber liner.

6. The improvement of claim 1, wherein said paddle further comprises a generally rectangular, planer paddle having a plurality of radially extending slots formed spaced apart from one another along a longitudinal length of said paddle.

7. The improvement of claim 6 further comprising:

said shaft having a paddle-receiving slot disposed in an end of said shaft within said mixing chamber, such that said paddle loosely fits within said slot.

8. The improvement of claim 7 further comprising said paddle having a notch formed therein for engagement with said paddle-receiving slot allowing a portion of said paddle to be in close proximity with an inlet end of said mixing chamber during rotation.

9. In a gun for mixing and discharging a chemical mixture, said gun having chemical supply means communicating through passages with an inlet end of a mixing chamber, a motor driven shaft mounted for rotation within said mixing chamber and a discharge outlet from said mixing chamber, the improvement comprising:

a disposable mixing chamber liner insertable within said mixing chamber;

means for releasably securing said disposable mixing chamber liner in sealed relation to said inlet end of said mixing chamber of said gun;

a disposable mixing paddle disposed within said mixing chamber liner for rotation; and means for releasably coupling said disposable mixing paddle to said shaft for rotation within said mixing chamber liner, wherein said coupling means includes said shaft having a paddle-receiving slot formed in an end thereof disposed within said mixing chamber, and said paddle having a generally planar portion engageable within said paddle-receiving slot of said shaft, such that said paddle loosely fits within said paddle-receiving slot allowing said paddle to move radially during rotation until said paddle engages an inner surface of said mixing chamber liner to scrape said inner surface of said mixing chamber liner during rotation to prevent buildup of said chemical mixture.

10. The improvement of claim 9 wherein said securing means comprises:

said gun having a first smooth annular shoulder adjacent said inlet end of said mixing chamber, a second enlarged shoulder adjacent said first shoulder, said second shoulder having a threaded external surface, and a transitional surface between said first and second shoulders;

said mixing chamber liner having an elongated cylindrical portion with an outwardly flared annular ridge at one end of the cylindrical portion and a tapered transitional portion adjacent another end forming a mixing chamber outlet; and a tubular housing having a threaded aperture at one end engageable with the threaded surface of the second shoulder, such that said flared annular ridge of said mixing chamber liner is sealingly engaged between said transitional surface of said gun and said tubular housing.

11. The improvement of claim 9 further comprising:

said paddle having a plurality of radially extending slots spaced from one another along a longitudinal length of said paddle.

12. The improvement of claim 9 further comprising:

said mixing chamber liner having an elongated cylindrical portion and a tapering transitional portion adjacent one end forming an outlet from said mixing chamber, such that said paddle is prevented from disengaging with said paddle-receiving slot by said tapering transitional portion of said mixing chamber liner.

13. In a gun for mixing and discharging a chemical mixture, said gun having chemical supply means communicating through passages with an inlet end of a mixing chamber, a motor driven shaft mounted for rotation within said mixing chamber and a discharge outlet from said mixing chamber, the improvement comprising:

a disposable mixing chamber liner insertable within said mixing chamber, said mixing chamber liner having an elongated cylindrical portion with an outwardly flared annular ridge at one end of the cylindrical portion and a tapered transitional portion adjacent another end forming a mixing chamber outlet;

said gun having a first smooth annular shoulder adjacent said inlet end of said mixing chamber, a second enlarged shoulder adjacent said first shoulder, said second shoulder having a threaded external surface, and a transitional surface between said first and second shoulders;

a tubular housing having a threaded aperture at one end engageable with the threaded surface of the second shoulder, such that said flared annular ridge of said mixing chamber liner is sealingly engaged between said transitional surface of said gun and said tubular housing for releasably securing said disposable mixing chamber liner in sealed relation to said inlet end of said mixing chamber of said gun;

said shaft having a paddle-receiving slot formed in an end thereof disposed within said mixing chamber; and a disposable mixing paddle disposed within said mixing chamber liner for rotation by said shaft, said paddle having a generally planer portion engageable within said paddle-receiving slot of said shaft, such that said paddle loosely fits within said paddle-receiving slot allowing said paddle to move radially during rotation until said paddle engages an inner surface of said mixing chamber liner to scrape said inner surface of said mixing chamber liner during rotation to prevent buildup of said chemical mixture, said paddle having a plurality of radially extending slots spaced from one another along a longitudinal length of said paddle, and said paddle retained within said paddle-receiving slot in a longitudinal direction by being in relatively close proximity to said tapering transitional portion of said mixing chamber liner.

* * * * *